US007481667B2

(12) United States Patent
Cheng

(10) Patent No.: US 7,481,667 B2
(45) Date of Patent: Jan. 27, 2009

(54) ELECTRICAL CONNECTOR

(75) Inventor: Chia-Chi Cheng, Taipei Hsien (TW)

(73) Assignee: Suyin Corporation, Taipei Hsien (TW)

( * ) Notice: Subject to any disclaimer, the term of this patent is extended or adjusted under 35 U.S.C. 154(b) by 368 days.

(21) Appl. No.: 11/493,553

(22) Filed: Jul. 27, 2006

(65) Prior Publication Data

US 2008/0026624 A1 Jan. 31, 2008

(51) Int. Cl.
*H01R 3/00* (2006.01)

(52) U.S. Cl. ..... 439/490; 439/676; 439/607

(58) Field of Classification Search ..... 439/607–610, 439/488–490, 676, 752.5, 751
See application file for complete search history.

(56) References Cited

U.S. PATENT DOCUMENTS 6,319,062 B1 * 11/2001 Ma et al. ..... 439/607
6,478,611 B1 * 11/2002 Hyland ..... 439/490
6,817,906 B2 * 11/2004 Zhou ..... 439/752.5

* cited by examiner

*Primary Examiner*—Edwin A. Leon
(74) *Attorney, Agent, or Firm*—Rosenberg, Klein & Lee

(57) ABSTRACT

An electrical connector has a body, two fasteners and multiple terminals. The body has two lugs formed on two upper ends of the body and two holes defined in two lower ends of the body. Each fastener has two hooks formed on two lower ends of the fastener and engaging the holes of the body, and two notches defined in two upper ends of the fastener and engaging the lugs of the body. Hence, the fasteners respectively engage the body securely. Furthermore, the fasteners are easily mounted onto the body.

3 Claims, 4 Drawing Sheets

ELECTRICAL CONNECTOR

BACKGROUND OF THE INVENTION

1. Field of the Invention

The present invention relates to an electrical connector, and more particularly to an electrical connector which can transfer communication signal.

2. Description of the Related Art

A conventional electrical connector has a body and multiple terminals. The body has an open end defined in the body and two holes defined in two opposite sides of the body. Two fasteners respectively engage the holes in the body. Each fastener has a lug to engage the holes in the body. In assembly, the terminals are mounted respectively in the open end of the body and are provided securely in the body via the fasteners.

However, the engagement of the holes of the body and the lugs of the fasteners are not stable such that the fasteners are easily detached from the body.

Therefore, the invention provides an electrical connector to mitigate or obviate the aforementioned problems.

SUMMARY OF THE INVENTION

The main objective of the present invention is to provide an electrical connector that is assembled easily and mounted stably.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
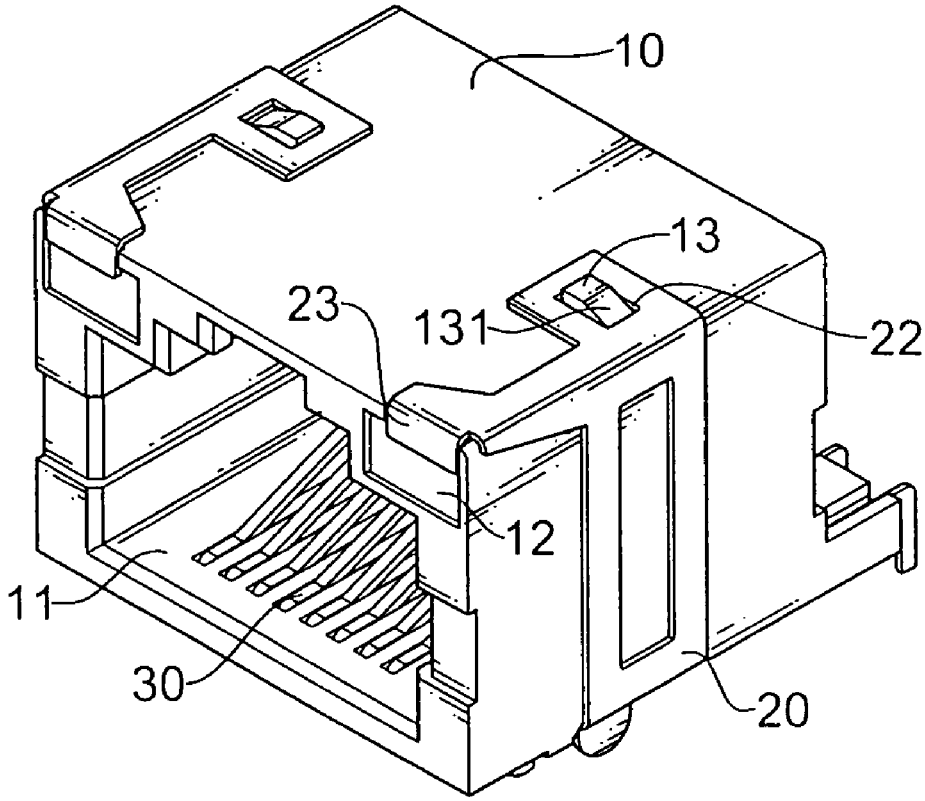
FIG. 1 is a perspective view of an electrical connector in accordance with the present invention.
Figure 2:
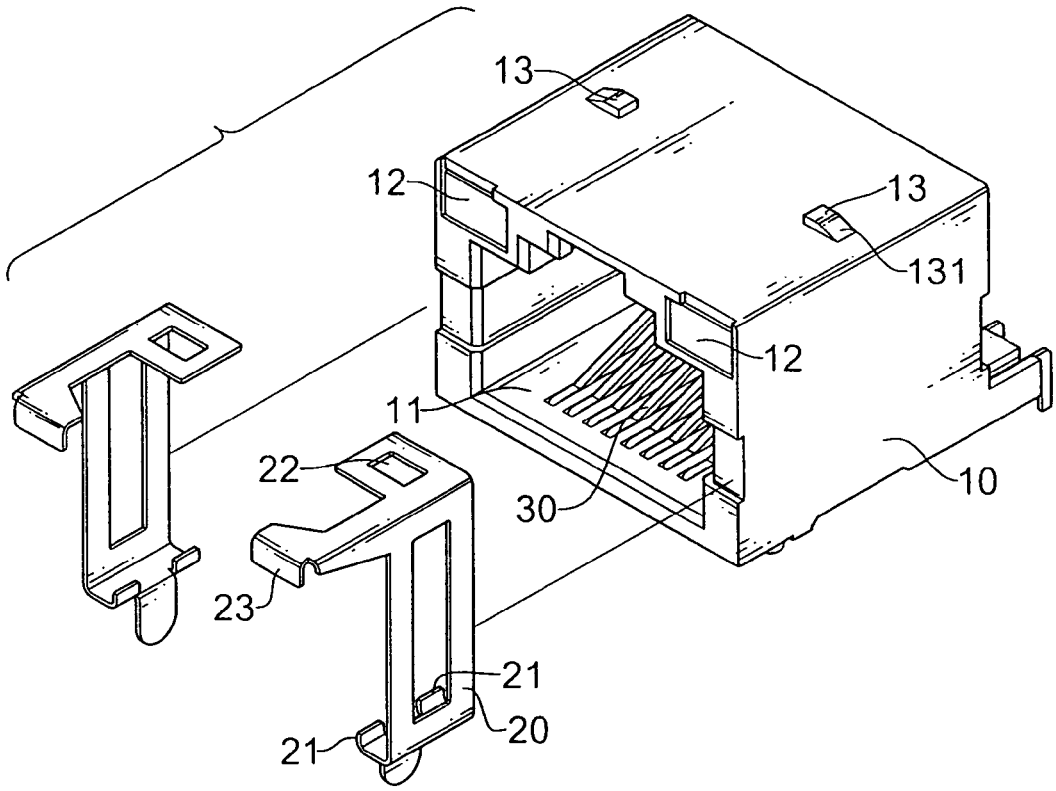
FIG. 2 is an exploded perspective view of the electrical connector in FIG. 1.
Figure 3:
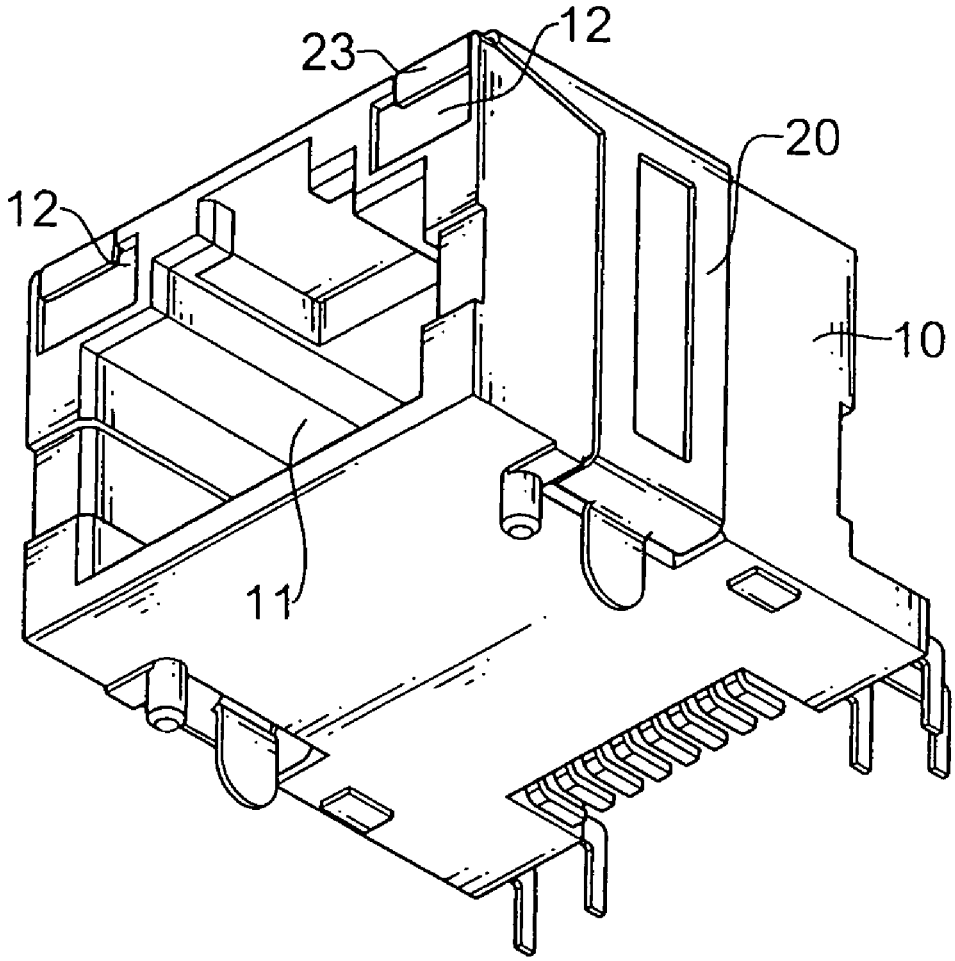
FIG. 3 is another perspective view of the electrical connector in FIG. 1.

With reference to FIGS. 1-3, an electrical connector in accordance with the present invention has a body (10), two fasteners (20) and multiple terminals (30).

Figure 4:
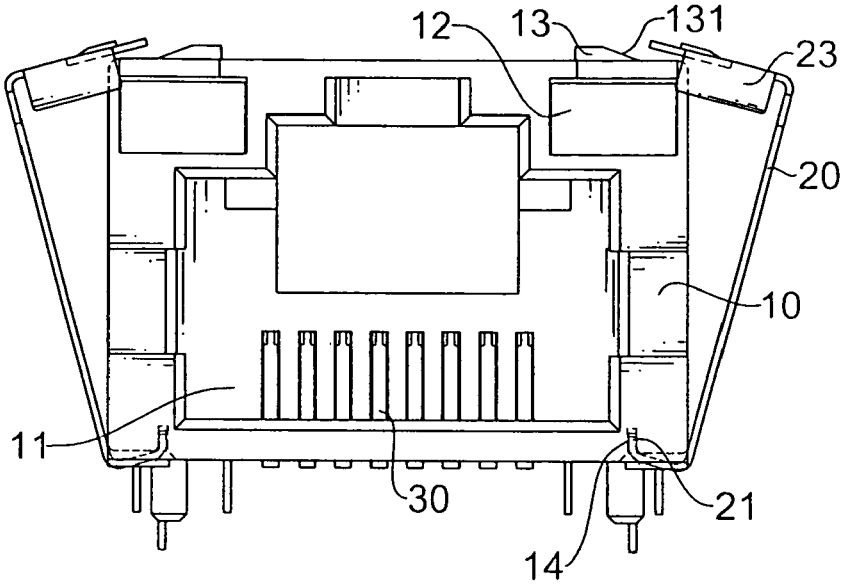
FIG. 4 is an operational front view of the electrical connector in FIG. 1 before assembly.

The body (10), which is made of plastic, has an open end (11) defined in an end of the body (10) and two light-emitting diodes (LEDs) (12) mounted oppositely on the open end (11). With further reference to FIG. 4, two lugs (13) are respectively formed oppositely on a top surface of the body (10).

Two notches (14) are respectively defined oppositely on a bottom surface of the body (10). Each lug (13) has a skewed surface (131) formed on the lug (13).

Each fastener (20) has two hooks (21) bent upward and formed in a lower end of the fastener (20) and a hole (22) defined through an upper end of the fastener (20). A shield (23) is bent downward and is formed on a side of each fastener (20).

Figure 5:
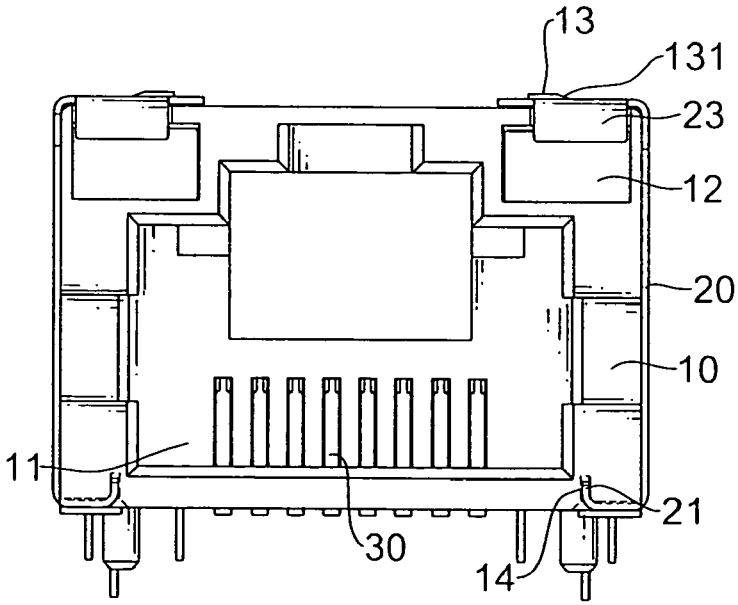
FIG. 5 is a front view of the electrical connector in FIG. 1.

With further reference to FIGS. 4 and 5, the multiple terminals (30) are inserted respectively into the open end (11) of the body (10). The hooks (21) of the fastener (20) respectively engage the notches (14) of the body (10), and the lugs (13) respectively engage the holes (22) of the fastener (20) via the feasibility of the skewed surfaces (131). The shield (23) of each fastener (20) is provided to an upper end of the corresponding LED (12) to prevent the LED (12) from detaching from the body (10).

Hence, the fasteners (20) respectively engage the body (10) securely. Furthermore, the fasteners (20) are easily mounted onto the body (10).

It is to be understood, however, that even though numerous characteristics and advantages of the present invention have been set forth in the foregoing description, together with details of the structure and function of the invention, the disclosure is illustrative only. Changes may be made in details, especially in matters of shape, size, and arrangement of parts within the principles of the invention to the full extent indicated by the broad general meaning of the terms in which the appended claims are expressed.

What is claimed is:

1. An electrical connector comprising:

a body having an open end defined in an end of the body;

two light-emitting diodes (LEDs) mounted oppositely on the open end;

two lugs respectively formed oppositely on a top surface of the body; and two notches respectively defined oppositely on a bottom surface of the body;

multiple fasteners, each having at least one hook bent upward, formed in a lower end of the fastener and corresponding to and engaging one of the notches of the body; and a hole defined through an upper end of the fastener and corresponding to and engaging one of the lugs of the body; and multiple terminals mounted in the body.

2. The electrical connector as claimed in claim 1, wherein each fastener has a shield bent downward, formed on a side of each fastener and provided to an upper end of one of the LEDs in the body.

3. The electrical connector as claimed in claim 1, wherein each lug of the body has a skewed surface formed on the lug.

* * * * *